US006711099B1

(12) United States Patent
Mock et al.

(10) Patent No.: US 6,711,099 B1
(45) Date of Patent: Mar. 23, 2004

(54) SETTING AND WINDING MECHANISM

(75) Inventors: Elmar Mock, Biel (CH); Elio Mariotto, Solothurn (CH)

(73) Assignee: Watch-U-License AG, Zug (CH)

( * ) Notice: Subject to any disclaimer, the term of this patent is extended or adjusted under 35 U.S.C. 154(b) by 17 days.

(21) Appl. No.: 10/257,074

(22) PCT Filed: Apr. 10, 2001

(86) PCT No.: PCT/CH01/00229

§ 371 (c)(1),
(2), (4) Date: Feb. 21, 2003

(87) PCT Pub. No.: WO01/77757

PCT Pub. Date: Oct. 18, 2001

(51) Int. Cl.[7] ..... G04B 19/24; G04B 27/00; G04B 27/02; G04B 3/00

(52) U.S. Cl. ..... 368/31; 368/190; 368/206

(58) Field of Search ..... 368/31–36, 185, 368/190, 196, 206, 319

(56) References Cited

U.S. PATENT DOCUMENTS 3,983,691 A * 10/1976 Schaller et al.
4,152,888 A * 5/1979 Namiki et al.
6,295,249 B1 * 9/2001 Takahashi et al. ..... 368/35

FOREIGN PATENT DOCUMENTS

CH 14 689/74 A4 4/1976
CH 613 588 A 10/1979

* cited by examiner

*Primary Examiner*—Vit Miska
(74) *Attorney, Agent, or Firm*—Robert E. Bushnell, Esq.

(57) ABSTRACT

A mechanism for setting and winding of a clockwork, with a winding button spindle, rotatable around its arbor and displaceable in the axial direction, and with a first gear arranged at a distance from the winding button spindle, rotatable around its arbor and displaceable in the direction of its arbor. The rotational movement of this first gear is operatively connected to the rotational movement of the winding button spindle via at least one additional gear. The axial displaceability of the first gear is operatively connected to the axial displaceability of the winding spindle via a first connection device, so that the first gear can be engaged in the axial direction with additional clockwork parts by axial displacement of the winding spindle. An additional connection device produces an operative connection between the winding spindle and a second gear, so that the second gear, as a result of axial displacement of the winding spindle, is pivoted around an arbor of a third gear operatively connected to the second gear.

8 Claims, 1 Drawing Sheet

SETTING AND WINDING MECHANISM

Figure 1:
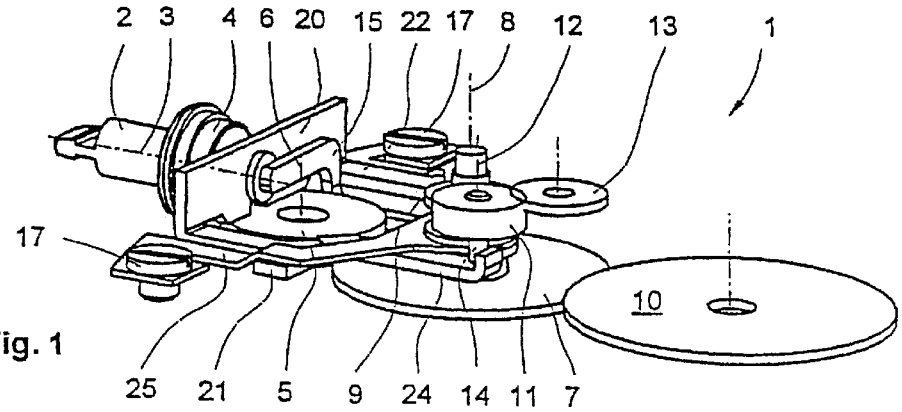

The present invention concerns a setting and winding mechanism for a mechanical clockwork, with or without automatic winding, or for a quartz clockwork, according to the preamble of the independent claim.

Dial clockworks, as used, for example, in wrist watches, ordinarily have a mechanism for setting the hands and for winding of a spring loading mechanism. A user operates this setting and winding mechanism generally via a winding button arranged on the watch housing, which is mounted to rotate on a spindle and can be displaced along it between several positions. The spindle generally runs roughly radially into the interior of the clockwork, where it cooperates with the clockwork part via a more or less complicated mechanism. In the different axial positions, a rotation on the winding button has a different effect on the clockwork parts.

The winding and setting mechanisms known from the prior art have different drawbacks and problems. One the one hand, they consist of very many parts, which has an adverse effect on manufacturing demands and production costs. Moreover, only two axial positions of a winding button wheel can be accomplished with an ordinary setting mechanism. In addition, these mechanisms have unduly large space requirements or have an unfavorable effect, in that setting of the axial position of the winding button leads to an undesired and disadvantageous adjustment of the other clockwork parts. Ordinary mechanisms also have a tendency to jam, so that there is a hazard that parts of the clockwork will no longer function. The radially running spindle and the pendulum present in automatic clockworks require the same space, so that the clockwork must be designed significantly thicker or the pendulum reduced in size, in order to avoid a situation in which the shaft comes in contact with the pendulum. A smaller pendulum has a disadvantageous effect on the accuracy of the clockwork.

A winding and setting mechanism having different drawbacks is known from Swiss Patent CH 441 126. In comparison with other clockworks, a significant size reduction of the pendulum of the automatic winding mechanism is tolerated, which necessarily leads to a deterioration in accuracy or to a reduction in power reserve of the clockwork. In addition, the gears that are engaged for setting the time are engaged in the radial direction via rocker bars and levers on circular paths. This leads to undesired and disadvantageous shifting of the hands, especially during coupling and decoupling of the set wheels. The design height of the clockwork cannot be minimized with the employed rocker bars and levers. Another disadvantage is that the number of moving parts is very large, which necessarily results in a complicated, costly mechanism that is difficult to adjust and prone to disturbance.

Another mechanism for setting the hands and winding a clockwork is known from CH 14 689/74. This mechanism is not suitable to solve the problems that occur especially in flat automatic clockworks. This arrangement has too many parts for the task being solved. A hazard of jamming also exists, because of the rigid connection of the different parts.

It is the task of the present invention to demonstrate a multifunctional, adaptable winding and setting mechanism that does not have a negative effect on the design height of the clockwork. The winding mechanism is supposed to have the smallest possible number of parts, which are connected to each other so that no undesired displacement of clockwork parts occurs. It is also supposed to be expandable in modular fashion.

The task is solved by the invention defined in the patent claims.

The setting mechanism according to the invention is designed so that it is expandable in modular fashion. Because of this, additional functions can be implemented in the same or different, especially modular-designed clockworks, by means of the same components or at least components of similar design. This means that the manufacturing expense in different clockworks is reduced, owing to the preferred "modular principle". The setting and winding movements exerted by the user on a spindle of a winding button is guided via several connected elements around spaces required by other clockwork parts. For example, the winding and setting mechanism is designed so that the space required by a pendulum of an automatic gauge is not touched. The mechanism disclosed here also makes possible a design in critical areas, for example, in the vicinity of the pendulum of an automatic gauge, that is not thicker than a gear typically used in a clockwork (about 0.2 to 0.3 mm).

Owing to the action principle of the mechanism according to the invention, it is also possible to implement more than two defined axial positions of a winding button wheel. Because of this, additional positions to control additional functions, like date, phase of the moon, alarm, etc., can be implemented, in addition to a position for setting of the hands, and a position for winding of the clockwork. The positions are secured by a locking function. The mechanism is designed so that the winding button spindle can additionally be used as a "pushbutton", in order to operate, say, a stopwatch.

In order to eliminate the problems inherent to the prior art, especially the undesired and disadvantageous displacement of the clockwork mechanism, the sensitive parts of the mechanism are preferably engaged with each other by translatory movement. Engagement by rotational movements around a spindle is deliberately avoided in critical cases. In less sensitive functions, for example, in the winding mechanism for the spring loading device, in which a displacement during coupling and decoupling entails no disadvantages, the corresponding movements, however, are quite acceptable.

The individual parts of the setting and winding mechanism disclosed here are configured so that they preferably integrate several functions. Because of this, it is possible to minimize the total number of necessary elements. In addition, the mechanism is designed so that it can be easily generalized to additional applications. Additional functions can be integrated and expanded via defined interfaces without having to redesign the entire mechanism. Certain connections that the mechanism according to the invention makes between the clockwork parts are deliberately configured flexibly, so that, during an incorrect adjustment of clockwork parts being engaged, the movement is temporarily stored. The possibility of incorrect functions is minimized on this account. The forces and displacements are deliberately transformed and optimized, with respect to the requirements, by the arrangement and dimensioning of the functionally connected devices.

A preferred variant of the setting mechanism according to the invention has a winding button spindle, movable in the axial direction and rotatable around its axis, and a gear, movable in the direction of its arbor and rotatable around its arbor, arranged at a spacing from the winding button spindle, the rotational movement of the gear being connected to the rotational movement of the winding button spindle via at least one additional gear. The axial displaceability of the gear is operatively connected by means of an elastic connection device to the axial displaceability of the winding spindle, so that the axially displaceable gear can be engaged in the axial direction with additional clockwork parts by axial displacement of the winding spindle. A connection device produces an operative connection between the winding spindle and an additional gear, so that the additional gear, as a result of axial displacement of the winding spindle, is pivoted around an arbor of a gear operatively connected to the additional gear. The setting mechanism, if required, has an element designed, so that, during incorrect setting of the gears being engaged or the clockwork part, it is elastically deformed and thus stores the movement. If necessary, one gear has a greater thickness than an additional gear engaging with it, so that a relative axial displacement between the two gears does not disengage the two gears.

Figure 2:
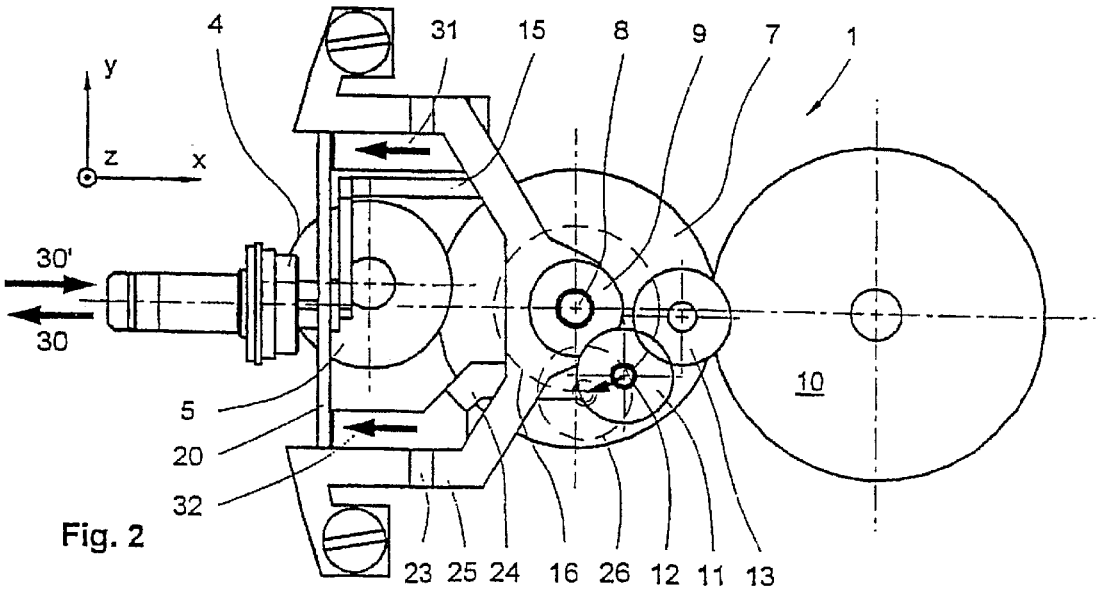
Figure 3:
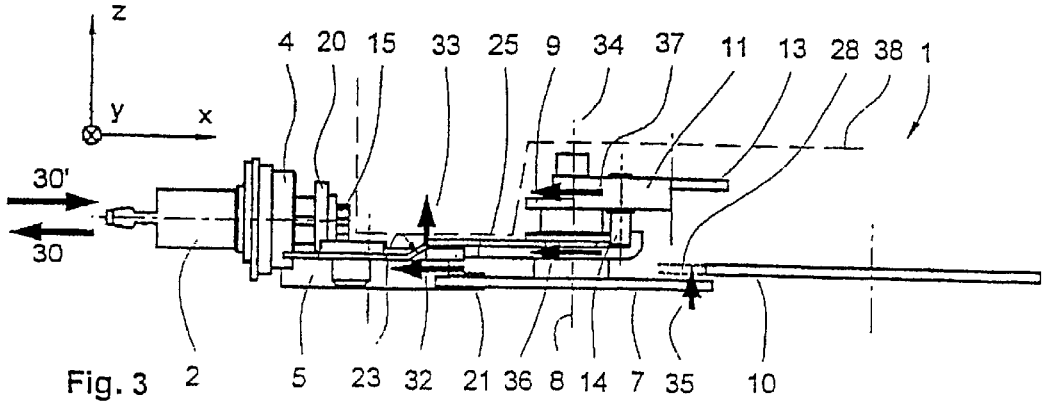

The invention is further explained with reference to the following figures:

In the figures:

FIG. 1 shows a winding and setting mechanism according to the invention in its perspective arrangement, FIG. 2 shows the setting mechanism according to FIG. 1 in a top view, FIG. 3 shows the setting mechanism according to FIG. 1 in a front view.

FIG. 1 shows a winding and setting mechanism 1 in a perspective view. A winding button spindle 2 is apparent, which is mounted rotatable around the first arbor 3 and movable along it. A first gear 4, also mounted rotatable around the first arbor 3 and coupled to rotation of the winding button spindle 2 via a square (not further shown), is arranged to be non-movable in the axial direction and engages with a second gear 5, arranged here at an angle of 90° to the first gear 4. The second gear 5 is mounted to rotate around a second arbor 6, and is also operatively connected to a third gear 7. The third gear 7 is rotatable around a third arbor 8 and mounted movable along it. The thickness of the second gear 5 is chosen here so that the third gear 7 remains in operative connection with the second gear 5, even after axial displacement. The third gear 7 can be made to engage with a fifth gear 10 by axial displacement along the third arbor 8. The teeth of the third and fifth gears 7, 10 engage with each other in the axial direction, in order to avoid undesirable displacement of the clockwork parts. If the participating gears are in a position in which coupling is not possible, the movement is stored by means of an elastic element, so that coupling occurs in a correct position.

A fourth gear 9 (cf. also FIG. 2) is rigidly connected to the third gear 7. The fourth gear 9 is engaged here with a sixth gear 11. The sixth gear 11 has a certain thickness, chosen so that the fourth gear 9 also remains in operative connection with the sixth gear 11 after axial displacement along the third arbor 8. The sixth gear 11 is again situated in the position depicted here, temporarily engaged with a seventh gear 13, and is mounted to rotate around a fourth arbor 12 that can be pivoted around the third arbor 8. The sixth gear 11 is therefore pivotable in controlled fashion around the third arbor 8 on a circular path 16 by means of a controlled movement (cf. FIG. 2).

In the position of the winding and setting mechanism 1 depicted here, the participating gears 4, 5, 7, 9, 11, 13 are operatively connected, so that rotation on the winding button spindle 2 causes a rotation of the seventh gear 13 around its arbor. This operative connection is only temporary and can be altered or eliminated by movement of the winding button (not further shown) or the winding button spindle 2 in the axial direction and by the winding and setting mechanism 1.

In a second position of the winding and setting mechanism 1, the gears 4, 5, 7, 9 are operatively connected, so that a rotation on the winding button (not further shown) or the winding button spindle 2 results in rotation of the fixed gear 10. Additional operative connections can be achieved by additional positions of the winding button spindle 2.

The winding button spindle 2 is connected here to a first control element 20, so that an axial displacement of the winding button spindle 2 in the direction of the first arbor 3 is transferred to it. Rotation of the winding button spindle 2 around arbor 3, however, has no effect on the control element 20. The control element 20, in the arrangement depicted here, is mounted so that it can be moved in translatory fashion in the direction of the first arbor 3. Two regions 21, 22 of control element 20 cooperate with an elastic element 25, fastened by means of two screws 17 on the bottom plate of the clockwork, so that a relative displacement between the winding button spindle 2 and the elastic element 25 acts on the elastic element 25 via control element 20, so that this is displaced at least in an area in a direction that lies roughly parallel to arbor 8 of an operatively connected gear 7, 9. Because of this, this operatively connected gear 7, 9, with a favorable tooth position, is engaged in the axial direction with an additional gear. Part of the element 25 has a slope 23 that cooperates with a part 21, 22 of a connection device 20, so that, during displacement of winding button spindle 2 in direction 30, the slope 23 moves perpendicular to it in another direction 33. If engagement is not possible because of an unfavorable position of the gearing or clockwork part, the elastic element 25 stores the movement to be executed by a reversible deformation. The elastic element 25 is designed, so that it has the smallest possible design height and preferably integrates several functions. On the one hand, it serves to transfer forces and movements to other elements of the clockwork and, on the other hand, serves as a means for temporary storage of movements. The elastic element 25, in the variant depicted here, is made from a thin sheet of spring steel and has several steps. It is operatively connected in the axial direction to the third and fourth gears 7, 9.

A lever 15 is operatively connected to the winding button spindle 2. The winding button spindle is configured, in the arrangement depicted here, so that it can also serve as a pushbutton for additional control of a function, for example, a stopwatch. In one position, the winding button spindle is temporarily displaceable inward. This movement is transferred via lever 15 to the clockwork mechanism being controlled. In this variant, coupling between the first control element 20 and the winding button spindle 2 is such that a temporary displacement of the winding button spindle in this position has no effect on the first control element 20. By means of additional spring elements (not further shown), the first control element 20 and the winding button spindle 2 are temporarily secured in their position, so that snapping-in is perceivable. Lever 15 is connected to winding button spindle 2 so that a translatory displacement of winding spindle 2 in a direction 30' is transferred to this lever 15 and not in the opposite direction 30.

A second elongated control element 24, bent on one end, is connected to the first control element 20. This control element 24 is designed to be elastic and arranged so that it exerts a certain pressure in the axial direction on a bearing axis 14 of the sixth gear 11. Because of this pressure on the bearing axis 14 and the pivotable arrangement of the fixed gear 11 around the third arbor 8, a situation is achieved in which, during rotation of the winding button spindle in one direction (so that the gear 9 rotates clockwise), engagement between the sixth gear 11 and the seventh gear 13 is temporarily released, since the entire sixth gear 11 pivots in controlled fashion around the third arbor 8. By rotation of the winding button spindle in the other direction, the sixth gear 11 and the seventh gear 13 are temporarily engaged. This property is very useful, in order to implement, for example, a date setting by rotation of the winding button spindle 2 in one direction and setting of the day of the week by rotation in the other direction. The sixth gear 11 is engaged with the seventh gear 13 in the radial direction. Undesirable displacement of the clockwork parts poses no problem here.

FIG. 2 shows the winding and setting mechanism 1 of FIG. 1 in a top view. The winding button spindle 2 is situated in the position depicted here in operative connection with lever 15. A displacement of winding button spindle 2 in the direction of the positive x-axis causes lever 15 to be displaced inward, so that an additional function in the interior of the clockwork can be controlled. By displacement of the winding button spindle 2 in the direction of a first arrow 30 parallel to the negative x-axis, the operative connection between winding button spindle 2 and lever 15 is released. Movement of the winding button spindle 2 is transferred via control element 20 (movement shown by arrows 31 and 32) and the element 25, configured elastically here, to the third and fourth gears 7, 9, so that these are displaced in the axial direction 8, here parallel to the z-axis. The third and fifth gears 7, 10 are temporarily engaged by this displacement.

The second control element 24, which is also displaced in the direction of arrow 32 with the first control element 25, causes the sixth gear 11 to be pivoted on a circular path 16 around arbor 8 into a second position 26 and therefore temporarily can no longer be engaged with the seventh gear 13. Because of this, the functions are deliberately separated. The second control element 24 also has a certain bending elasticity.

FIG. 3 shows a side view of the setting and winding mechanism 1 according to FIGS. 1 and 2. The operatively connected movements are shown by means of arrows 30, 32, 33, 34 and 37. Displacement of the winding button spindle 2 in the direction of the first arrow 30 has an effect on the first control element 20, which is shown by the third arrow 32. The region 21 of control element 20 cooperates with a chamfering angle 23 of the elastic element 25, so that this is raised as a result of shifting of region 21, at least roughly perpendicular in areas, in the direction of the fourth arrow 33. This lifting is transferred to the third and fourth gears 7, 9 via the elastic element 25. These two gears are then shifted in the direction of a fifth arrow 34, provided there is a favorable tooth position of the gears being engaged, so that the third gear 7 engages with the fifth gear 10 in a position 28. Engagement is shown by a sixth arrow 35. If, as a result of unfavorable position of the participating gears, displacement is not possible, the elastic element 25 is deliberately deformed so that the displacement is temporarily stored on this account. When the tooth position is favorable, the gears 7, 10 are then engaged.

Displacement of the first control element 20 is simultaneously transferred to the second control element 24. By this movement, which is depicted by a seventh arrow 36, the sixth gear is pivoted in controlled fashion around the third arbor 8 in the direction of an eighth arrow 37 on a circular path 16 (cf. FIG. 2), so that operative connection between the sixth gear 11 and the seventh gear 13 is temporarily interrupted.

The parts of the winding and setting mechanism 1 depicted here preferably consist of metal or plastic. Because of deliberate integration of several functions in one part, a situation is achieved in which the number of parts is deliberately minimized. The winding and setting mechanism is designed very flat, so that the space of a pendulum 38 (depicted by a dash-dot line) is not adversely restricted.

What is claimed is:

1. A mechanism for setting and winding of a clockwork, with a winding button spindle, rotatable around its arbor and displaceable in the axial direction, and with a first gear arranged at a distance from the winding button spindle, rotatable around its arbor and displaceable in the direction of its arbor, in which the rotational movement of this first gear is operatively connected to the rotational movement of the winding button spindle via at least one additional gear, characterized by the fact that the axial displaceability of the first gear is operatively connected to the axial displaceability of the winding spindle by means of a first connection device, so that the first gear can be engaged in the axial direction with additional clockwork parts by axial displacement of the winding spindle, and that an additional connection device produces an operative connection between the winding spindle and a second gear, so that this second gear, as a result of axial displacement of the winding spindle, is pivoted around an arbor of a third gear operatively connected to the second gear.

2. The mechanism according to claim 1, characterized by the fact that a part of a connection device is designed, so that it is elastically deformed at an incorrect position of the gear being engaged or the clockwork parts.

3. The mechanism according to claim 1, characterized by the fact that a part of the connection device is elastic and bent, consists of metal or plastic and is optionally multi-armed.

4. The mechanism according to claim 1, characterized by the fact that at least a part of the connection device is mounted, so that it can be displaced in translatory fashion in the direction of an arbor.

5. A setting mechanism according to claim 1, characterized by the fact that a part has a slope that cooperates with a part of a connection device, so that, during displacement of the winding button spindle in a direction, the slope moves perpendicular to it in another direction.

6. A setting mechanism according to claim 1, characterized by the fact that an element is arranged, so that it forces a gear in the axial direction on an arbor so that this gear, during rotation of winding button spindle in a direction around an arbor, pivots an additional gear.

7. The mechanism according to claim 1, characterized by the fact that a lever is operatively connected to the winding button spindle, so that a translatory displacement of winding button spindle can be transferred to this lever in a direction and not in an opposite direction.

8. The mechanism according to claim 1, characterized by the fact that a gear has a greater thickness than a second gear engaging with it, so that a relative axial displacement between the two gears does not release engagement between the two gears.

* * * * *